US007213727B2

(12) United States Patent
Kokubo

(10) Patent No.: US 7,213,727 B2
(45) Date of Patent: May 8, 2007

(54) NOZZLE FOR A LIQUID CONTAINER AND A LIQUID CONTAINER

(75) Inventor: Shigehiko Kokubo, Osaka (JP)

(73) Assignee: Rohto Pharmaceutical Co., Ltd. (JP)

( * ) Notice: Subject to any disclaimer, the term of this patent is extended or adjusted under 35 U.S.C. 154(b) by 275 days.

(21) Appl. No.: 10/686,409

(22) Filed: Oct. 14, 2003

(65) Prior Publication Data

US 2004/0079766 A1 Apr. 29, 2004

(30) Foreign Application Priority Data

Oct. 23, 2002 (JP) ..... 2002-308504
Mar. 13, 2003 (JP) ..... 2003-067739

(51) Int. Cl.
*B65D 37/00* (2006.01)

(52) U.S. Cl. ..... 222/212; 215/320; 222/566

(58) Field of Classification Search ..... 222/212, 222/246, 571, 556–570; 215/343, 344, 346, 215/320

See application file for complete search history.

(56) References Cited

U.S. PATENT DOCUMENTS 1,403,197 A * 1/1922 Rieck ..... 222/516
1,892,788 A * 1/1933 Schwartz ..... 222/562
2,889,089 A * 6/1959 Herrick et al. ..... 222/540
3,117,702 A * 1/1964 Henchert ..... 222/543
3,209,963 A * 10/1965 Krieps et al. ..... 222/543
3,282,477 A * 11/1966 Henchert ..... 222/541.9
3,926,348 A * 12/1975 Lutzker ..... 222/189.07
4,387,819 A * 6/1983 Corsette ..... 215/273
4,782,964 A * 11/1988 Poore et al. ..... 215/216
4,948,003 A * 8/1990 Munoz ..... 215/237
5,002,206 A * 3/1991 Allegretti et al. ..... 222/212
5,154,325 A * 10/1992 Ryder et al. ..... 222/189.06
5,249,712 A * 10/1993 Lontrade et al. ..... 222/189.08
5,398,829 A * 3/1995 Stubbs ..... 215/256
5,799,836 A * 9/1998 Lee ..... 222/189.07
5,897,033 A * 4/1999 Okawa et al. ..... 222/212
6,845,887 B1 * 1/2005 Granger et al. ..... 222/153.06
2004/0074925 A1 * 4/2004 Faurie ..... 222/212

FOREIGN PATENT DOCUMENTS

DE 3409867 * 9/1985 ..... 222/566
EP 1266840 * 12/2002 ..... 222/566
JP 7-275322 10/1995
JP 9-156662 6/1997
JP 2001-97384 4/2001
JP 2001-158459 6/2001
JP 3081570 8/2001
JP 2002-321758 11/2002

* cited by examiner

*Primary Examiner*—Lien M. Ngo
(74) *Attorney, Agent, or Firm*—Gerald E. Hespos; Anthony J. Casella

(57) ABSTRACT

A lower portion of a nozzle is held hermetically in contact with an inner circumferential surface of the tubular neck of a container, and an inner surface of a cap is mounted to an outer surface of the tubular neck. A discharging hole of the nozzle is hermetically sealed by an inner top surface of the cap. A ring-shaped projection is formed on an upper portion of the nozzle for hermetically contacting an inner surface of the cap. Thereby, double sealing is provided in cooperation with hermetic sealing of the discharging hole of the nozzle by the inner top surface of the cap. The nozzle prevents a liquid leak and liquid dripping from the nozzle and form liquid drops independently of a dripping angle.

17 Claims, 12 Drawing Sheets

NOZZLE FOR A LIQUID CONTAINER AND A LIQUID CONTAINER

BACKGROUND OF THE INVENTION

1. Field of the Invention

This invention relates to a nozzle for a liquid container which can securely prevent a liquid leak and a liquid dripping from a nozzle, and a liquid container provided with such a nozzle.

2. Description of the Related Art

There has been conventionally proposed a liquid container constructed such that a container body containing a liquid such as an eye-drop, a nose-drop or a contact-lens cleaning solution is pressed by fingers to cause the content liquid to drip from a discharging hole of a nozzle.

A known liquid container as above is normally comprised of three members: a container body 1, a nozzle 2 and a cap 3 as shown in FIGS. 13A and 13B. The nozzle 2 is mounted by hermetically bringing an outer circumferential surface 2*b* of a lower portion 2*a* of the nozzle 2 into contact with an inner circumferential surface 1*b* of a tubular neck portion 1*a* of the container body 1. The cap 3 is mounted by bringing an inner circumferential surface 3*a* of the cap 3 into contact with an outer circumferential surface 1*c* of the tubular neck portion 1*a* while an internal thread 3*b* formed in the inner circumferential surface 3*a* of the cap 3 is engaged with an external thread 1*d* formed on the outer circumferential surface 1*c* of the tubular neck portion 1*a*, and pressing an inner top surface 3*c* of the cap 3 against a top surface 2*d* of a discharging hole 2*c* of the nozzle 2 to provide a hermetic sealing for the discharging hole 2*c* as shown in Japanese Unexamined Patent Publication No. 9-156662.

This publication disclosed a liquid container of the so-called screw cap type. The cap 3 can be loosened and detached by being turned by 360° in reverse direction. A plurality of (at least three or more) ring-shaped fins 2*e* whose edges are elastically deformed to be hermetically brought into contact with the inner circumferential surface 1*b* of the tubular neck portion 1*a* upon inserting the lower portion 2*a* of the nozzle 2 into the tubular neck portion 1*a* are formed at specified intervals while being vertical spaced apart. By this elastic deformation of the ring-shaped fins 2*e*, the outer circumferential surface 2*b* of the lower portion 2*a* of the nozzle 2 and the inner circumferential surface 1*b* of the tubular neck portion 1*a* are attached to a higher degree and an occurrence of a crack in the tubular neck portion 1*a* due to dimensional errors of the tubular neck portion 1*a* and the nozzles 2 can be prevented.

Another known liquid container is, as shown in FIGS. 14A and 14B, constructed such that an outer circumferential surface 2*b* of a lower portion 2*a* of a nozzle 2 is hermetically brought into contact with an inner circumferential surface 1*b* of a tubular neck portion 1*a* of a container body 1 and a cap 3 is mounted by engaging a locking arm 3*d* on an inner circumferential surface 3*a* of the cap 3 with a locking projection 1*e* on an outer circumferential surface 1*c* of the tubular neck portion 1*a* while bringing the inner circumferential surface 3*a* of the cap 3 into contact with the outer circumferential surface 1*c* of the tubular neck portion 1*a*, and inserting a projection 3*e* on an inner top surface 3*c* of the cap 3 into a discharging hole 2*c* of the nozzle 2 to hermetically seal the discharging hole 2*c* while forcibly widening it as shown in Japanese Unexamined Patent Publication NO. 10-329855.

This publication discloses a liquid container of the so-called twist cap type. Upon detaching the cap 3, the locking arm 3*d* and the locking projection 1*e* are disengaged by twisting the cap 3 by about 90°.

However, the former publication discloses the liquid container constructed such that the discharging hole 2*c* is hermetically sealed by pressing the inner top surface 3*c* of the cap 3 against the top surface 2*d* of the discharging hole 2*c* of the nozzle 2, whereas the latter publication discloses the liquid container constructed such that the discharging hole 2*c* is hermetically sealed by inserting the projection 3*e* on the inner top surface 3*c* of the cap 3 into the discharging hole 2*c* of the nozzle 2 while forcibly widening the discharging hole 2*c*. For example, there are problems that a sealing performance varies and a load exerted on the nozzle cracks the nozzle due to a variation in tightening torque in the case of the screw type cap of the former publication and due to a variation of assembling precision of parts such as the cap and the nozzle in the case of the twist type cap of the latter publication. There has been a demand for a nozzle structure which, regardless of the type of the cap, can securely prevent an occurrence of a liquid leak from the cap 3 and the discharging hole 2*c* of the nozzle 2 and has a sealing performance which is not influenced by variations in assembling precision and torque.

With the liquid containers disclosed in the respective publications, a content liquid "a" can be caused to drip from the discharging hole 2*c* of the nozzle 2 by pressing the container body 1 by fingers with the nozzle 2 faced substantially right down as shown in FIG. 15A. However, if the nozzle 2 is, for example, inclined to face obliquely downward while being turned upside down as shown in FIG. 15B, the content liquid "a" leaks out to an upper portion 2*f* of the nozzle 2 from the discharging hole 2*c*. If the nozzle 2 is inclined to face obliquely upward in this state as shown in FIG. 15C, the content liquid "a" may not be easily caused to drip since it runs down from the upper portion 2*f* to the tubular neck portion 1*a* of the container body 1 or it cannot be formed well into drops. Therefore, there has been a demand for a nozzle constructed such that a liquid leak from the nozzle can be securely prevented and drops can be easily formed independently of a dripping angle.

SUMMARY OF THE INVENTION

It is an object of the present invention to provide a nozzle for a liquid container and a liquid container which are free from the problems residing in the prior art.

It is another object of the present invention to provide a nozzle for a liquid container and a liquid container which can securely prevent a liquid leak and a liquid dripping from a nozzle and easily form liquid drops independently of a dripping angle.

According to an aspect of the present invention, a liquid container having a tubular neck portion is provided with a nozzle on a top of the tubular neck portion. A cap is mounted on the tubular neck portion. The nozzle includes a discharging hole hermetically sealed by an inner top portion of the cap, and a ring-shaped projection formed on an upper portion of the nozzle.

These and other objects, features and advantages of the present invention will become more apparent upon a reading of the following detailed description and accompanying drawings.

DETAILED DESCRIPTION OF THE PREFERRED EMBODIMENTS

Figure 1:
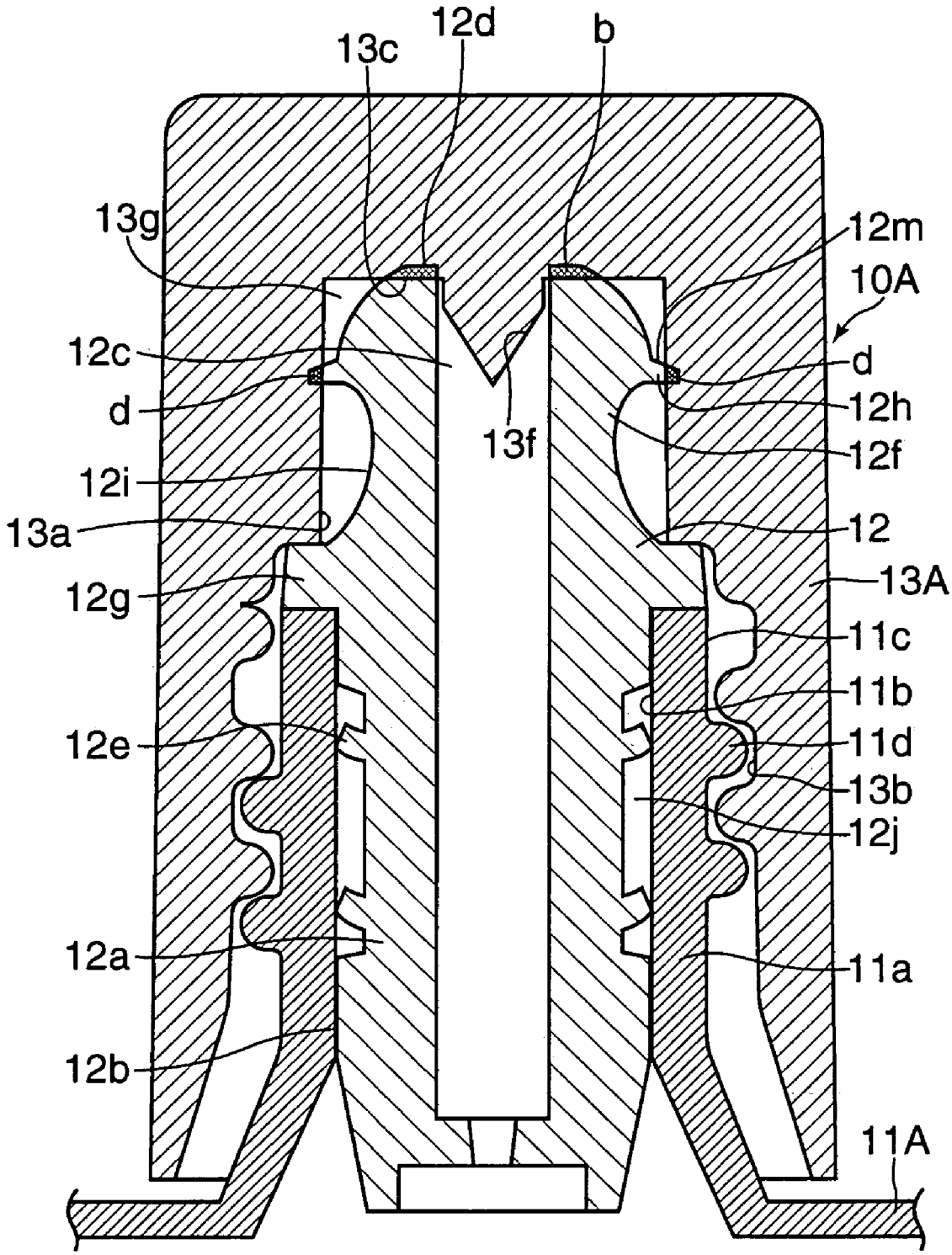
FIG. 1 is an enlarged front view in section showing a nozzle, a fitting portion of a container body and a cap of a liquid container of the screw cap type according to an embodiment of the invention.
Figure 2:
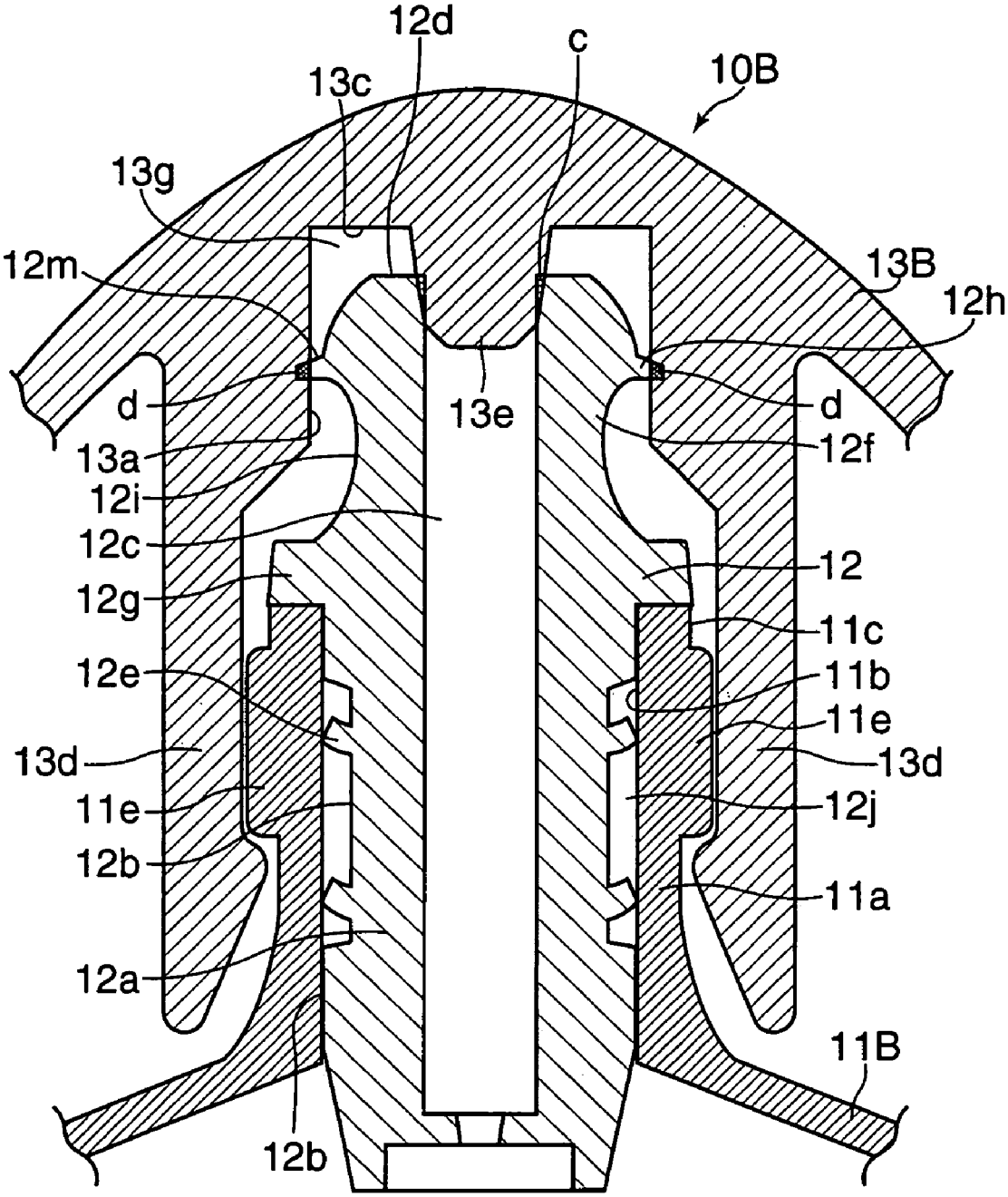
FIG. 2 is an enlarged front view in section showing a nozzle, a fitting portion of a container body and a cap of a liquid container of the twist cap type according to another embodiment of the invention.

A preferred embodiment of the present invention will be described in detail. Referring to FIGS. 1 and 2, a container body 11A of a liquid container 10A of a screw cap type is integrally formed with a tubular neck portion 11*a* in its upper portion and an external thread 11*d* is integrally formed on an outer circumferential surface 11*c* of the tubular neck portion 11*a*.

A nozzle 12 is so inserted that an outer circumferential surface 12*b* of a lower portion 12*a* is hermetically brought into contact with an inner circumferential surface 11*b* of the tubular neck portion 11*a*, and is positioned along an inserting direction by the contact of a flange portion 12*g* formed at a boundary between the lower portion 12*a* and an upper portion 12*f* with the top surface of the tubular neck portion 11*a*, and a discharging hole 12*c* is formed in a top surface 12*d* of the upper portion 12*f*.

The material of the nozzle 12 is not particularly restricted provided that it is a synthetic resin suitable for the nozzle molding. However, in consideration of fittability to the tubular neck portion 11*a* and other factors, the nozzle 12 is preferably made of a so-called soft synthetic resin. Among soft synthetic resins, a low-density polyethylene (LDPE), a linear low-density polyethylene (LLDPE), a polypropylene (PP) are suitable for the above molding. A method for molding the nozzle 12 is not particularly restricted since the suitable method differs depending on the synthetic resin to be used. In the case of using the LDPE, LLDPE, PP or the like, the nozzle 12 is preferably molded by injection molding or extrusion molding. Further, an antibacterial treatment may be suitably applied if necessary.

The cap 13A has an internal thread 13*b* integrally formed in an inner circumferential surface 13*a*, and a projection 13*f* fittable into the discharging hole 12*c* of the nozzle 12 while defining a clearance thereto is integrally formed on an inner top surface 13*c*.

Upon mounting the cap 13A, the inner circumferential surface 13*a* of the cap 13A is fitted to the outer circumferential surface 11*c* of the tubular neck portion 11*a* while engaging the internal thread 13*b* of the cap 13A with the external thread lid of the tubular neck portion 11*a* of the container body 11A, whereby the inner top surface 13*c* of the cap 13A can be pressed against the top surface 12*d* of the discharging hole 12*c* of the nozzle 12 to hermetically seal the discharging hole 12*c*. It should be noted that the top surface 12*d* of the discharging hole 12*c* of the nozzle 12 is elastically deformed when the inner top surface 13*c* of the cap 13A is pressed against the top surface 12*d* and this deformed section is shown by crosshatching b.

Conversely, the cap 13A can be loosened by being turned by about 360° in a direction opposite from the one in which the cap 13A is turned upon being attached to the nozzle 12 and then can be detached.

In FIG. 2, the container body 11B of the liquid container 10B of the twist cap type is integrally formed with a tubular neck portion 11*a* in its upper portion and a locking projection 11*e* is integrally formed on an outer circumferential surface 11*c* of the tubular neck portion 11*a*.

The nozzle 12 is so inserted that an outer circumferential surface 12*b* of a lower portion 12*a* is hermetically brought into contact with an inner circumferential surface 11*b* of the tubular neck portion 11*a*, and is positioned along an inserting direction by the contact of a flange portion 12*g* formed at a boundary between the lower portion 12*a* and an upper portion 12*f* with the top surface of the tubular neck portion 11*a*, and a discharging hole 12*c* is formed in a top surface 12*d* of the upper portion 12*f*.

The material of the nozzle 12 is not particularly restricted provided that it is a synthetic resin suitable for the nozzle molding. However, in consideration of fittability to the tubular neck portion 11*a* and other factors, the nozzle 12 is preferably made of a so-called soft synthetic resin. Among soft synthetic resins, a low-density polyethylene (LDPE), a linear low-density polyethylene (LLDPE), a polypropylene (PP) are suitable for the above molding. A method for molding the nozzle 12 is not particularly restricted since the suitable method differs depending the synthetic resin to be used: In the case of using the LDPE, LLDPE, PP or the like, the nozzle 12 is preferably molded by injection molding or extrusion molding.

The cap 13B has a locking arm 13*d* integrally formed on an inner circumferential surface 13*a*, and a projection 13*e* fittable into the discharging hole 12*c* of the nozzle 12 while forcibly widening the discharging hole 12*c* of the nozzle 12.

Upon mounting the cap 13B, the locking arm 13*d* of the cap 13B is engaged with the locking projection 11*e* of the tubular neck portion 11*a* while engaging the inner circumferential surface 13*a* of the cap 13B with the outer circumferential surface 11*c* of the tubular neck portion 11*a* of the container body 11B, whereby the discharging hole 12*c* of the nozzle 12 is forcibly widened by the projection 13*e* of the cap 13B to hermetically seal the discharging hole 12*c*. It should be noted that the discharging hole 12*c* of the nozzle 12 is elastically deformed when the projection 13*e* of the cap 13B is fitted into the discharging hole 12*c* of the nozzle 12 while forcibly widening it, and this deformed section is shown by crosshatching c.

Conversely, the cap 13B can be loosened by being twisted by about 90° in a direction opposite from the one in which the cap 13B is turned upon being attached to the nozzle 12 and then can be detached.

The nozzle 12 can be commonly used for the liquid container 10A of the screw cap type shown in FIG. 1 and the liquid container 10B of the twist cap type shown in FIG. 2, including a liquid container 10B' of the twist cap type shown in FIG. 12 to be described later.

FIGS. 4A, 4B, 4C and 4D are a front view, a section, a plan view and a bottom view showing one example of the nozzle 12. An about one-third upper part of the upper portion 12*f* is formed into a slightly flat semispherical shape, and a ring-shaped projection 12*h* to be hermetically brought into contact with the inner circumferential surface 13*a* of the cap 13A, 13B is integrally formed on the outer circumferential surface of a maximum-diameter section of this semispherical portion.

Although this ring-shaped projection 12*h* has a substantially trapezoidal cross section, the shape, size and the like thereof do not particularly matter provided that a hermetic state can be established between the nozzle 12 and the cap 13A, 13B. However, in order to improve operability and durability, for example, by reducing a resistance during the attachment and detachment of the cap 13A, 13B, the ring-shaped projection 12*h* may be suitably formed with a tapered portion 12*m* or a chamfered portion if necessary.

In FIGS. 1 and 2, the ring-shaped projection 12*h* of the nozzle 12 is elastically deformed when being hermetically brought into contact with the circumferential surface 13*a* of the cap 13 and this deformed section is shown by crosshatching d.

A about two-third lower part of the upper portion 12*f* of the nozzle 12 is so largely scooped out as to be gradually narrowed from a position below the ring-shaped projection 12*h* and then gradually thickened toward the flange portion 12*g*. Thus, a largely constricted portion 12*i* is integrally formed below the ring-shaped projection 12*h*, i.e., between the ring-shaped projection 12*h* and the flange portion 12*g*.

Further, at least two ring-shaped fins 12*e* are formed on the outer circumferential surface 12*b* of the lower portion 12*a* of the nozzle 12 while being vertically spaced apart. These ring-shaped fins 12*e* are different from a multitude of (at least three) ring-shaped fins disclosed in Japanese Unexamined Patent Publication No. 9-156662 and vertically spaced at specified intervals. Specifically, the middle ring-shaped fin is deleted from those disclosed in this publication, thereby forming an airtight air pool 12*j* wider than the one of the above prior art ring-shaped fins by one interval when the nozzle 12 is so hermetically inserted that the outer circumferential surface 12*b* of the lower portion 12*a* of the nozzle 12 is brought into contact with the inner circumferential surface 11*b* of the tubular neck portion 11*a* of the container body 11.

Further, as shown in FIGS. 1 and 2, when the inner circumferential surface 13*a* of the cap 13A, 13B hermetically touches the ring-shaped projection 12*h* of the nozzle 12 upon mounting the cap 13A, 13B, an airtight air pool 13*g* is formed between a hermetically sealed portion of the cap 13A, 13B and the nozzle 12, i.e., a hermetically sealed portion of the inner top surface 13*c* of the cap 13A and the top surface 12*d* of the discharging hole 12*c* of the nozzle 12 in FIG. 1 or a hermetically sealed portion of the projection 13*e* of the cap 13B and the discharging hole 12*c* of the nozzle 12 in FIG. 2, and a hermetic contact portion of the inner circumferential surface 13*a* of the cap 13A, 13B and the ring-shaped projection 12*h* of the nozzle 12.

The functions of the nozzle 12 of the liquid container 10A, 10B thus constructed are described.

When the cap 13A, 13B is mounted on the liquid container 10A, 10B, the inner circumferential surface 13*a* of the cap 13A, 13B hermetically touches the ring-shaped projection 12*h* of the nozzle 12. Thus, sealing is doubly provided in cooperation of the hermetic sealing between the inner top surface 13*c* of the cap 13A and the top surface 12*d* of the discharging hole 12*c* of the nozzle 12 in the liquid container 10A of FIG. 1, or the hermetic sealing between the projection 13*e* of the cap 13B and the discharging hole 12*c* of the nozzle 12 in the liquid container 10B of FIG. 2. Therefore, a liquid leak can be securely prevented.

Further, the airtight air pool 13*g* is formed between the hermetically sealed portion of the cap 13A, 13B and the nozzle 12, i.e., the hermetically sealed portion of the inner top surface 13*c* of the cap 13A and the top surface 12*d* of the discharging hole 12*c* of the nozzle 12 in FIG. 1 or the hermetically sealed portion of the projection 13*e* of the cap 13B and the discharging hole 12*c* of the nozzle 12 in FIG. 2, and the hermetic contact portion of the inner circumferential surface 13*a* of the cap 13A, 13B and the ring-shaped projection 12*h* of the nozzle 12. Thus, a liquid leak from the discharging hole 12*c* of the nozzle 12 can be more securely prevented by the action of an air pressure in this air pool 13*g*.

Since the ring-shaped fins 12*e* whose edge are elastically deformed during the insertion of the nozzle 12 to hermetically touch the inner circumferential surface 11*b* of the tubular neck portion 11*a* of the container body 11 are formed on the outer circumferential surface 12*b* of the lower portion 12*a* of the nozzle 12, the outer circumferential surface 12*b* of the lower surface 12*a* of the nozzle 12 and the inner circumferential surface 11*b* of the tubular neck portion 11*a* are attached to a higher degree by the elastic deformation of the ring-shaped fins 12*e* and an occurrence of a crack in the tubular neck portion 11*a* due to a dimensional error of the tubular neck portion 11*a* and the nozzle 12 can be prevented.

Further, since the airtight air pool 12*j* is formed between the hermetic contact portions of the respective ring-shaped fins 12*e* and the inner circumferential surface 11*b* of the tubular neck portion 11*a*, a liquid leak through a clearance between the tubular neck portion 11*a* of the container body 11 and the nozzle 12 can be securely prevented by the action of an air pressure in this air pool 12*j*.

Figure 11A:
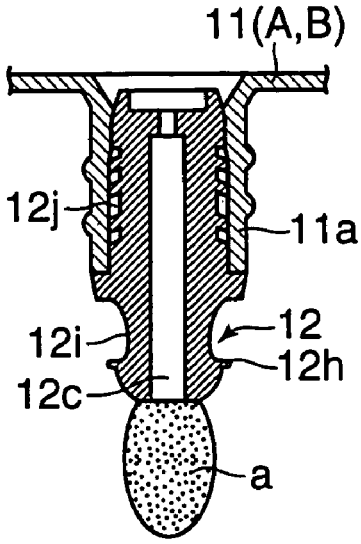
FIGS. 11A, 11B, 11C are front views in sections showing discharged states of a content liquid in a state where the nozzle is faced substantially right down, in a state where the nozzle is inclined to face obliquely downward, and in a state where the nozzle is inclined to face obliquely upward from the state of FIG. 11B, respectively.

On the other hand, the content liquid "a" can be caused to drip from the discharging hole 12*c* of the nozzle 12 by pressing the container body 11 by fingers with the nozzle 12 faced substantially right down for dripping as shown in FIG. 11A after the cap 13A, 13B is detached.

Figure 11B:
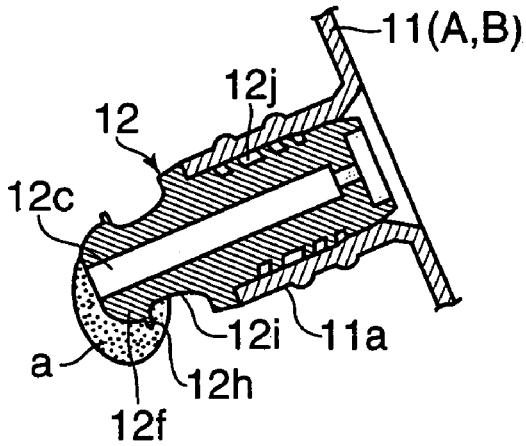

In the case that the nozzle 12 is inclined to face obliquely downward as shown in FIG. 11B before the content liquid "a" is caused to drip from the discharging hole 12*c* of the nozzle 12, the content liquid "a" comes out of the discharging hole 12*c* and runs down to the upper portion 12*f* of the nozzle 12.

Figure 11C:
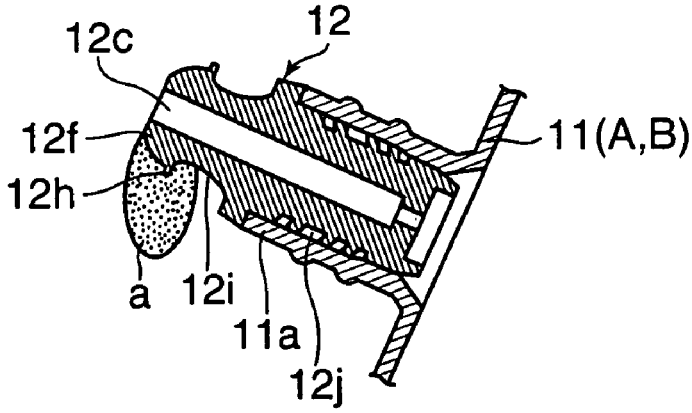

As shown in FIG. 11C, if the nozzle 12 is further inclined to face obliquely upward from this state, the content liquid "a" cannot be easily caused to drip since it runs down to the tubular neck portion 11*a* of the container body 10A, 10B from the upper portion 12*f* or cannot be formed well into drops. In such a case, since the ring-shaped projection 12*h* serves as a barrier wall for damming up the content liquid "a" trying to run down, a liquid leak can be securely prevented. In other words, the ring-shaped projection 12*h* has a barrier-wall function to prevent the liquid leak.

The higher the barrier wall by the ring-shaped projection 12*h*, the better the barrier wall effect. Thus, the liquid leak can be more effectively prevented by making the barrier wall by the ring-shaped projection 12*h* higher by forming the constricted portion 12*i* below the ring-shaped projection 12*h* of the nozzle 12.

Further, since the ring-shaped projection 12*h* functions as a core for forming liquid drops from the dammed-up content liquid "a" by the surface tension, the content liquid "a" drips better as a result. Further, drops can be easily formed not only when the nozzle 12 is faced substantially right down, but also when the nozzle 12 is horizontally held or inclined to face obliquely downward. In other words, liquid drops can be easily formed independently of a dripping angle. Thus, the content liquid "a" can be caused to drip via the ring-shaped projection 12*h* of the nozzle 12. In other words, the ring-shaped projection 12*h* also has a core function for forming the liquid drops.

The nozzle 12 shown in FIGS. 4A to 4D is formed such that the about one-third upper part of the upper portion 12*f* is formed into a slightly flat semispherical shape, and the about two-third lower part thereof is largely curved inward to be first thinned from the position below the ring-shaped projection 12*h* and then gradually thickened toward the flange portion 12*g*, thereby integrally forming the largely constricted portion 12*i* below the ring-shaped projection 12*h*, i.e., between the ring-shaped projection 12*h* and the flange portion 12*g*.

Figure 5A:
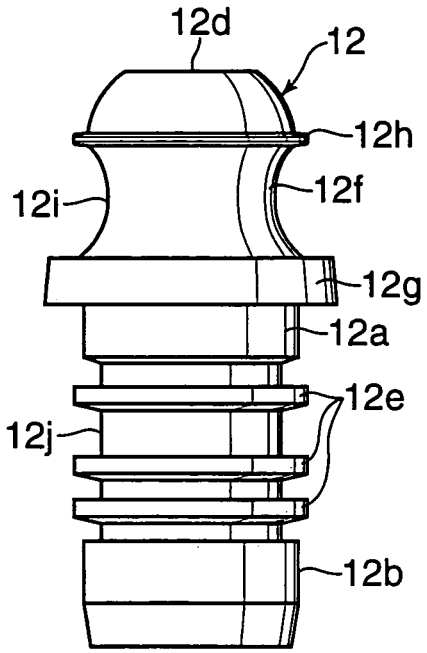
FIGS. 5A and 5B are a front view and a section of a first modified nozzle.
Figure 5B:
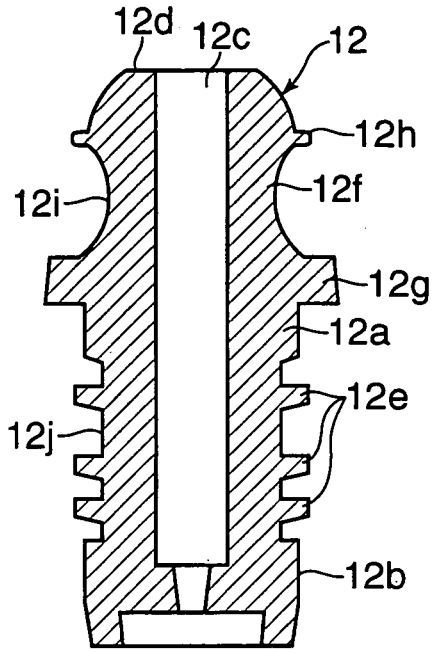

Contrary to this, as in a first modification shown in FIGS. 5A and 5B, the about one-third upper part of the upper portion 12*f* of the nozzle 12 may be formed into a slightly flat semispherical shape, and the about two-third lower part thereof may have its upper section gradually thickened toward its upper end so that the upper end is continuous with a maximum-diameter portion of the semispherical portion and has its lower section gradually thickened toward its bottom end coupled to the flange portion 12*g*, thereby a deep semispherical constricted portion 12*i* integrally formed between the ring-shaped projection 12*h* and the flange portion 12*g*.

Figure 6A:
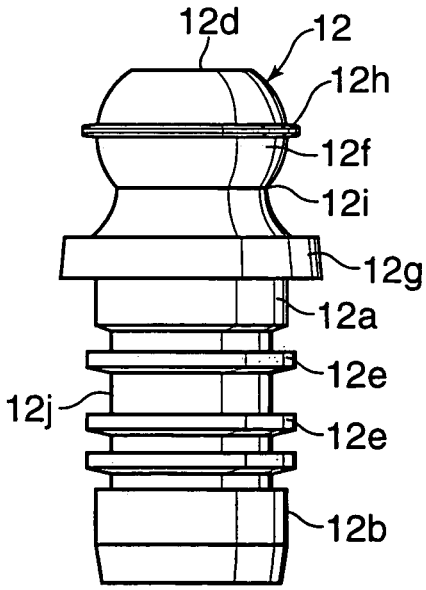
FIGS. 6A and 6B are a front view and a section of a second modified nozzle.
Figure 6B:
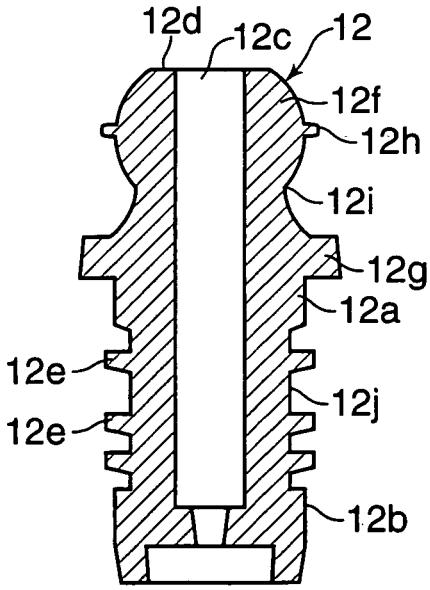

Further, as in a second modification shown in FIGS. 6A and 6B, the about two-third upper part of the upper portion 12*f* of the nozzle 12 may be formed into a slightly flat spherical shape, and the about one-third lower part thereof may have its upper section gradually thinned toward its upper end so that its upper end is continuous with a minimum-diameter portion of the spherical portion and have its lower section gradually thickened toward its bottom end coupled to the flange portion 12*g*, thereby integrally forming a constricted portion 12*i* below the ring-shaped projection 12*h*, i.e., between the ring-shaped projection 12*h* and the flange portion 12*g*.

Figure 7A:
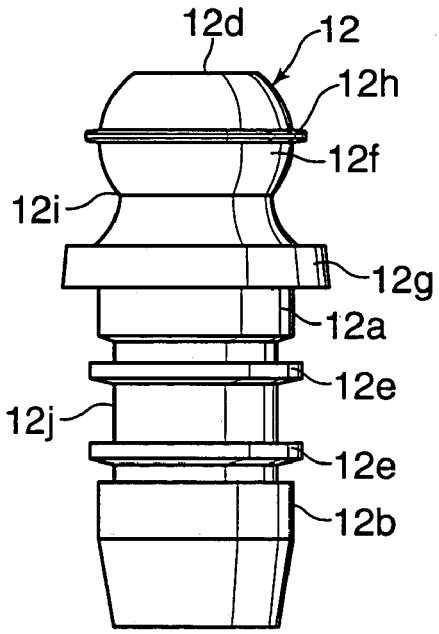
FIGS. 7A and 7B are a front view and a section of a third modified nozzle having two ring-shaped fins.
Figure 7B:
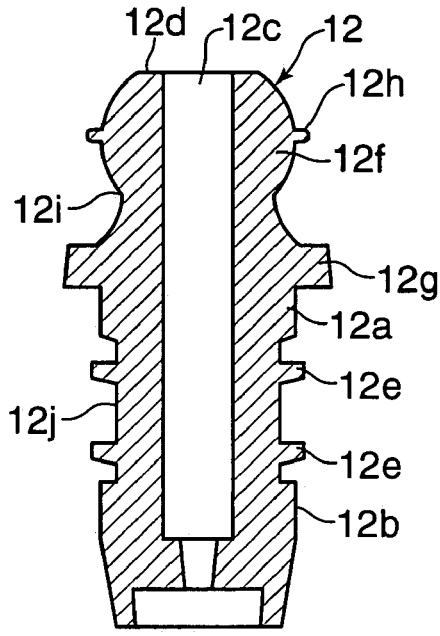

In the first modification shown in FIGS. 5A and 5B and the second modification shown in FIGS. 6A and 6B, three vertically spaced-apart ring-shaped fins 12*e* are formed on the outer circumferential surface 12*b* of the lower portion 12*a* of the nozzle 12, and a wide airtight air pool 12*j* is formed by widening the interval between the two upper ring-shaped fins 12*e*. However, as shown in FIGS. 7A and 7B, two vertically spaced-apart ring-shaped fins 12*e* may be formed similar to the nozzle 12 of FIGS. 4A to 4D and a wide airtight air pool 12*j* may be formed by widening the interval between these two ring-shaped fins 12*e*.

Figure 8A:
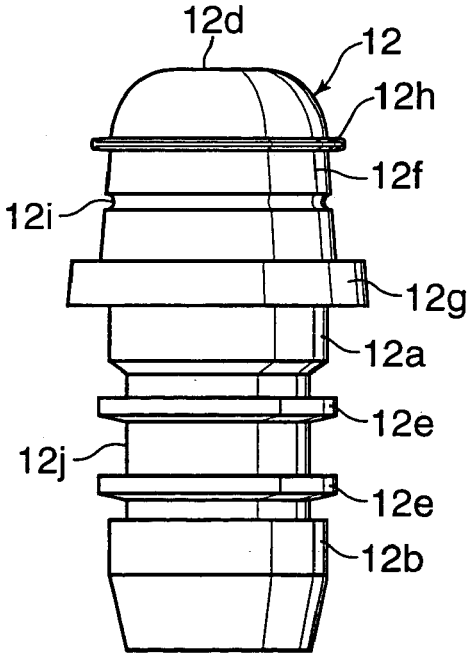
FIGS. 8A and 8B are a front view and a section of a fourth modified nozzle.
Figure 8B:
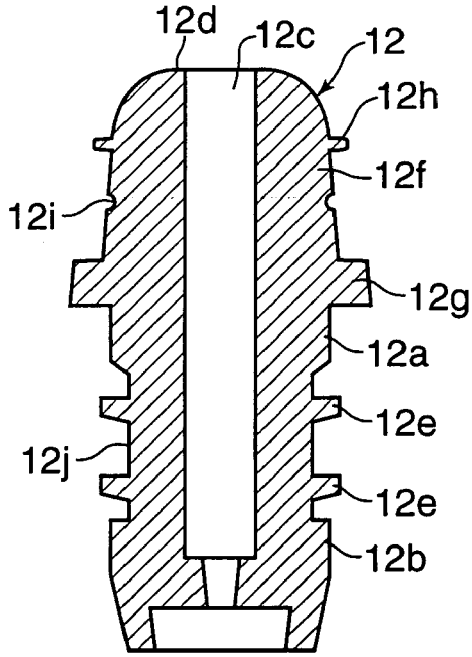

Further, as in a fourth modification shown in FIGS. 8A and 8B, the about one-third upper part of the upper portion 12*f* of the nozzle 12 may be formed into a slightly flat semispherical shape, the about two-third lower part thereof may be almost entirely made as thick as a maximum-diameter portion of the semispherical portion up to the flange portion 12*g*, and a shallow semispherical constricted portion 12*i* may be integrally formed between the ring-shaped projection 12*h* and the flange portion 12*g*.

Figure 9A:
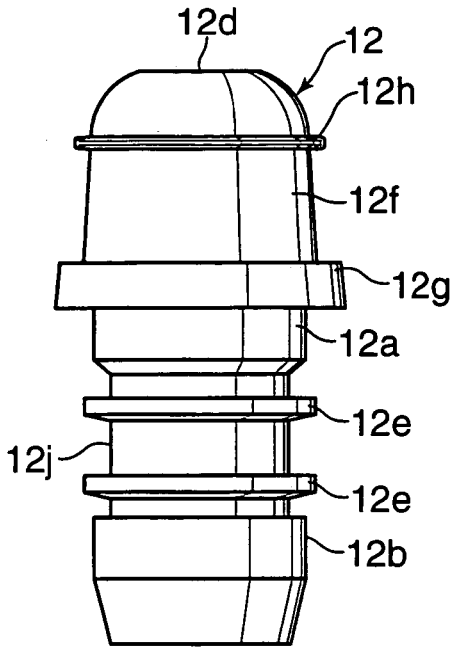
FIGS. 9A and 9B are a front view and a section of a fifth modified nozzle.
Figure 9B:
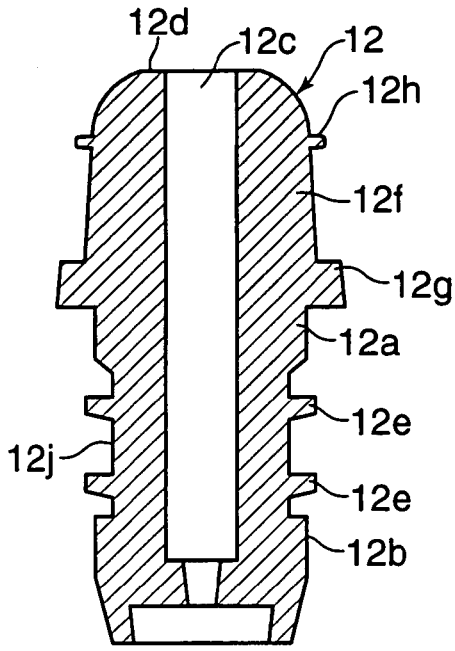

Furthermore, as in a fifth modification shown in FIGS. 9A and 9B, the about one-third upper part of the upper portion 12*f* of the nozzle 12 may be formed into a slightly flat semispherical shape, and the about two-third lower part thereof may be almost entirely made as thick as a maximum-diameter portion of the semispherical portion up to the flange portion 12*g*. What the fifth modification differs from the other modifications is that no constricted portion 12*i* is integrally formed between the ring-shaped projection 12*h* and the flange portion 12*g*. Even if no constricted portion 12*i* is formed, double sealing is provided as described above by hermetically brining the inner circumferential surface 13*a* of the cap 13 into contact with the ring-shaped projection 12*h*. Thus, this modification also has an effect of securely preventing a liquid leak.

Figure 10A:
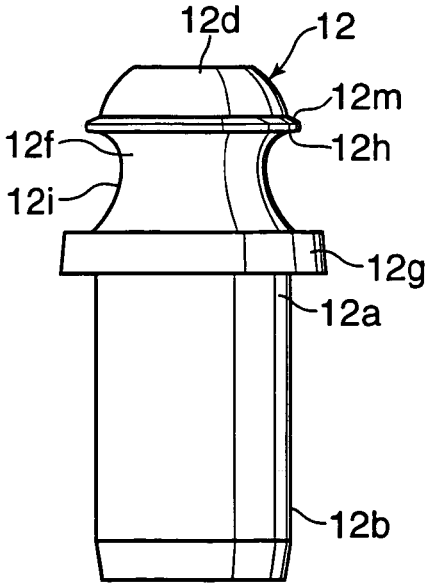
FIGS. 10A and 10B are a front view and a section of a sixth modified nozzle.
Figure 10B:
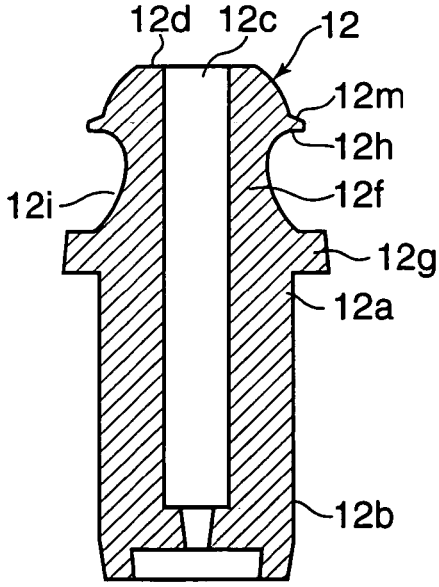

Further, as in a sixth modification shown in FIGS. 10A and 10B, the lower portion 12*a* of the nozzle 12 may be formed straight without forming the ring-shaped fins 12*e* on the outer circumferential surfaces 12*b* thereof. The lower portion 12*a* may be undetachably fixed to the tubular neck portion 11*a* by a known fusing method with the outer circumferential surface 12*b* thereof hermetically held in contact with the inner circumferential surface 11*b* of the tubular neck portion 11*a*.

Figure 3B:
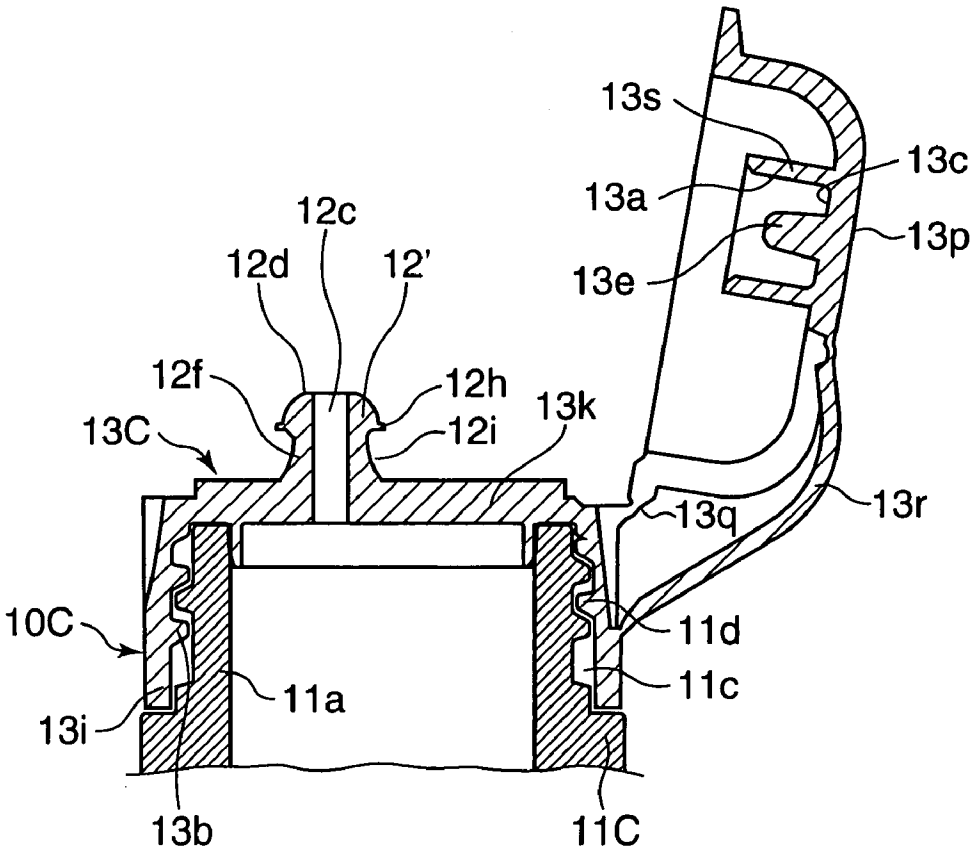
FIGS. 3A and 3B are enlarged front views in section showing a liquid container of the hinge cap type and a cap according to still another embodiment of the invention, showing a state when an upper lid is closed, and another state when the upper lid is opened, respectively.
Figure 3A:
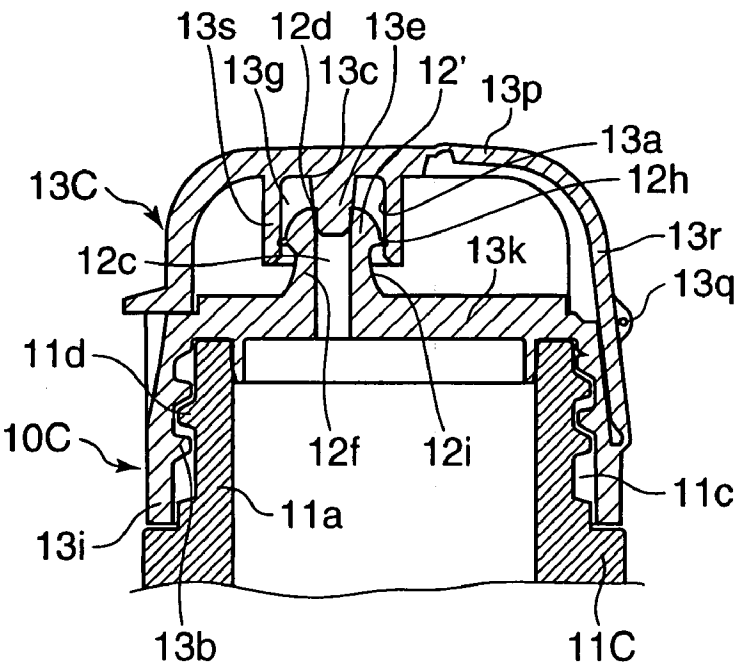
Figure 4A:
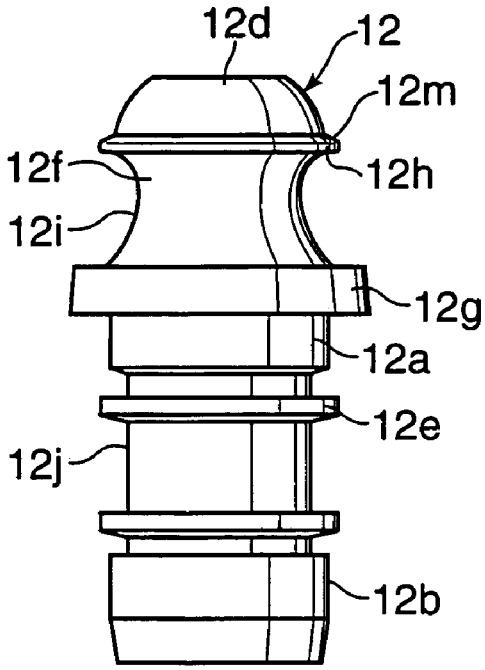
FIGS. 4A, 4B, 4C and 4D are a front view, a section, a plan view and a bottom view of the nozzle used in the liquid container shown in FIGS. 1 and 2.
Figure 4B:
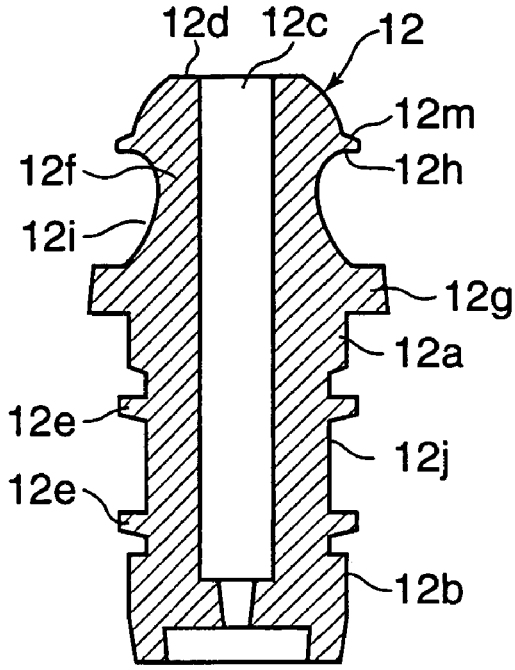
Figure 4C:
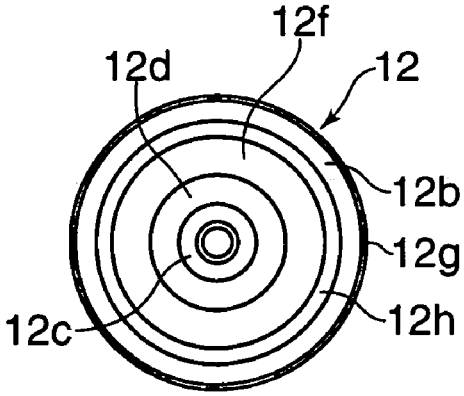
Figure 4D:
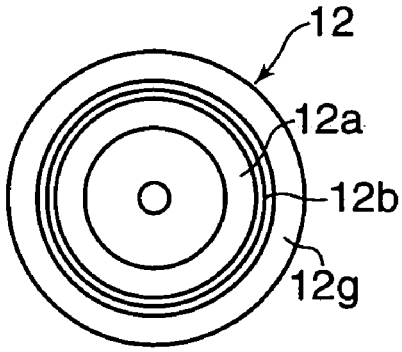

Although the nozzle 12 shown in FIGS. 1 and 2 is of the type that is hermetically inserted into the tubular neck portion 11*a* of the container body 11A, 11B, the nozzle structure of this embodiment is also applicable to a liquid container 10C of the hinged cap type in which a nozzle 12' is integrally formed with a cap 13C as shown in FIGS. 3A and 3B.

Specifically, the container body 11C of the liquid container 10C of the hinged cap type is integrally formed with a large-diameter tubular neck portion 11*a* at its upper part, and an external thread 11*d* is integrally formed on an outer circumferential surface 11*c* of the tubular neck portion 11*a*.

The cap 13C has an internal thread 13*b* integrally formed in an inner circumferential surface 13*a* of a large-diameter portion 13*i*, and the nozzle 12' is integrally formed on a top portion 13*k*. A discharging hole 12*c* is formed in a top surface 12*d* of the nozzle 12'.

An upper lid 13*p* is integrally coupled to a side of the top portion 13*k* of the cap 13C via a hinge 13*q*. It should be noted that the top portion 13*k* and the upper lid 13*p* are doubly coupled by a larger hinge 13*r* for reinforcement.

A projection 13*e* fittable into the discharging hole 12*c* of the nozzle 12' while forcibly widening the discharging hole 12*c* and a tubular portion 13*s* having an inner circumferential surface 13*a* to be fitted on an outer circumferential surface 12*b* of the nozzle 12' are integrally formed on an inner top surface 13*c* of the upper lid 13*p*.

The cap 13C is hermetically mounted by engaging the internal thread 13*b* of the cap 13C with the external thread 11*d* of the tubular neck portion 11*a* of the container body 11C. Since it is not necessary to detach the cap 13C from the container body 11C in this embodiment, the cap 13C may be undetachably fixed by a known fusing method after being mounted on the container body 11C instead of being fixed by the engagement of the external and internal threads.

When the upper lid 13*p* is closed using the hinges 13*q*, 13*r* thereafter (see FIG. 3A), the projection 13*e* is fitted into the discharging hole 12*c* of the nozzle 12' while forcibly widening it, whereby the discharging hole 12*c* can be hermetically sealed.

Conversely, when the upper lid 13*p* is opened using the hinges 13*q*, 13*r* (see FIG. 3B), the projection 13*e* comes out of the discharging hole 12*c* of the nozzle 12' to open the discharging hole 12*c*.

The material of this nozzle 12' is not particularly restricted provided that it is a synthetic resin suitable for molding the cap 13C including the hinges 13*q*, 13*r*. It is preferable to form the nozzle 12' of a so-called soft synthetic resin. Among soft synthetic resins, a polypropylene (PP) is more preferably used. Further, an antibacterial treatment may be suitably applied if necessary. A molding method for the hinged cap 13C is not particularly restricted since the preferable method differs depending on the synthetic resin to be used. However, it is preferable to mold the cap 13C by injection molding and extrusion molding.

Basically similar to the nozzle 12 of FIGS. 1 and 2, the nozzle 12' is such that an about one-third upper part of an upper portion 12*f* is formed into a slightly flat semispherical shape and an about two-third lower part thereof is largely curved inward to be gradually thinned from a position below a ring-shaped projection 12*h* and then to be gradually thinned toward its bottom end coupled to the top portion 13*k*, thereby integrally forming a largely constricted portion 12*i* below the ring-shaped projection 12*h*, i.e., between the ring-shaped projection 12*h* and the top portion 13*k*.

The functions of the nozzle 12' of the liquid container constructed as above are described.

When the upper lid 13*p* of the cap 13C of the liquid container 10C is closed, the inner circumferential surface 13*a* of the tubular portion 13*s* of the cap 13C is hermetically brought into contact with the ring-shaped projection 12*h* of the nozzle 12'. Thus, sealing is doubly provided in cooperation with the hermetic sealing of the discharging hole 12*c* by the projection 13*e* fitted into the discharging hole 12*c* of the nozzle 12' while forcibly widening it. Therefore, a liquid leak can be securely prevented.

Further, an airtight air pool 13*g* is formed in the hermetically sealed portion between the cap 13C and the nozzle 12', i.e., between the hermetically sealed portion of the projection 13*e* of the cap 13C and the discharging hole 12*c* of the nozzle 12' and the hermetic contact portion of the inner circumferential surface 13*a* of the tubular portion 13*s* of the cap 13C and the ring-shaped projection 12*h* of the nozzle 12'. Thus, a liquid leak from the discharging hole 12*c* of the nozzle 12 can be more securely prevented by the action of an air pressure in this air pool 13*g*.

It should be noted that no description is given here on the functions and effects when the upper lid 13*p* is opened to cause the content liquid "a" to drip from the discharging hole 12*c* of the nozzle 12' since they are the same as those described with reference to FIGS. 11A to 11C.

In the liquid container 10B of the twist cap type shown in FIG. 2, the ring-shaped projection 12*h* of the nozzle 12 is hermetically brought into contact with the inner circumferential surface 13*a* of the cap 13B when the cap 13B is mounted, thereby forming an airtight air pool 13*g* between the hermetically sealed portion of the projection 13*e* of the cap 13B and the discharging hole 12*c* of the nozzle 12 and the hermetic contact portion of the inner circumferential surface 13*a* of the cap 13B and the ring-shaped projection 12*h* of the nozzle 12.

Figure 12A:
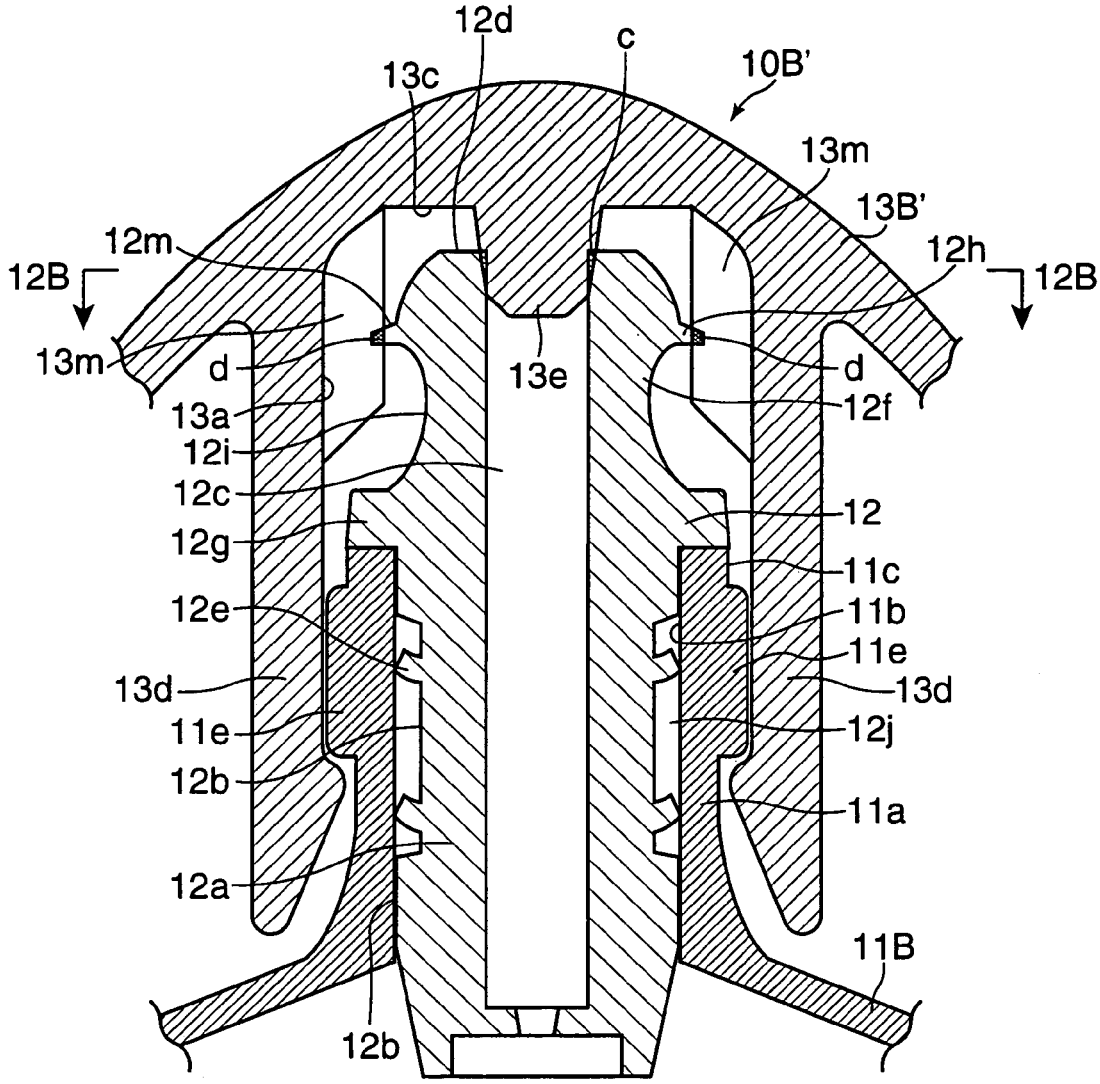
FIG. 12A is an enlarged front view in section showing a nozzle, a fitting portion of a container body and a cap of a liquid container of the twist cap type according to a seventh modification.
Figure 12B:
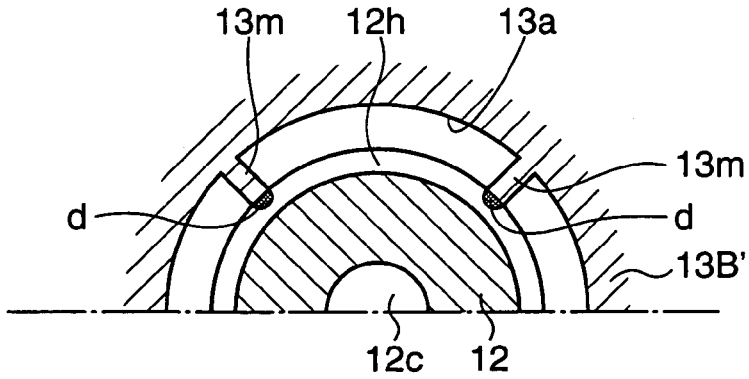
FIG. 12B is a section taken along the line 12B—12B in FIG. 12A.
Figure 13A:
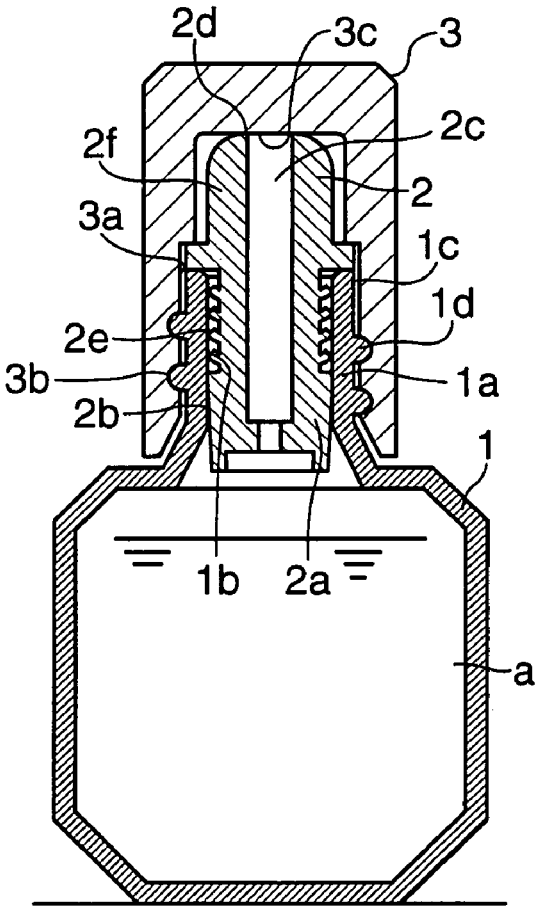
PRIOR ART FIG.13A
FIGS. 13A and 13B are front views in section of a prior art liquid container, showing a state when a cap is mounted and when the cap is detached, respectively.
Figure 13B:
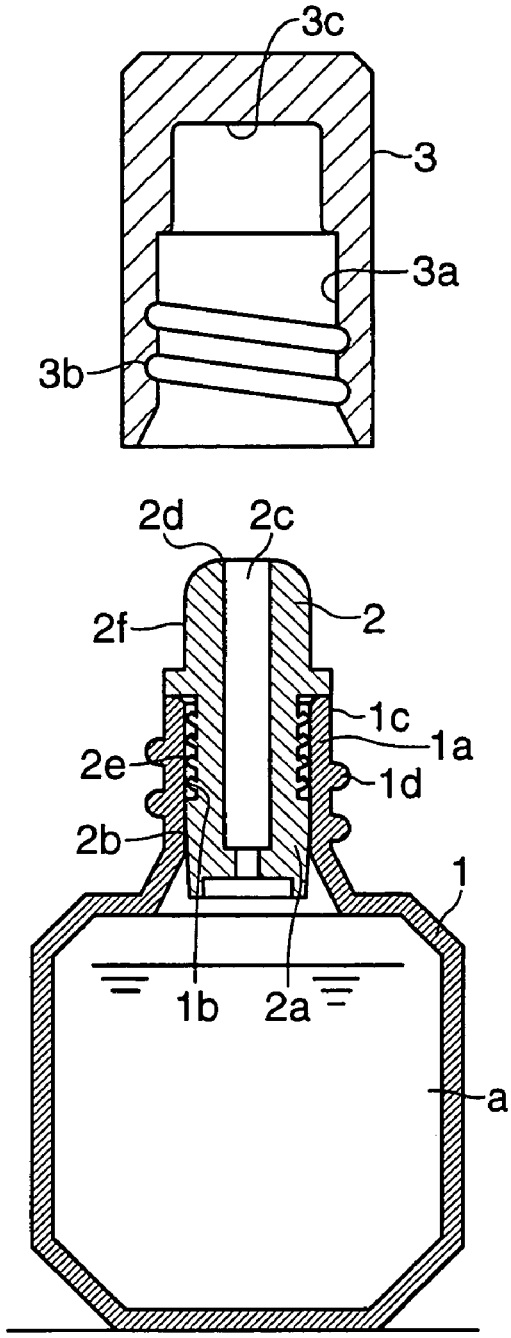
PRIOR ART FIG.13B
Figure 14B:
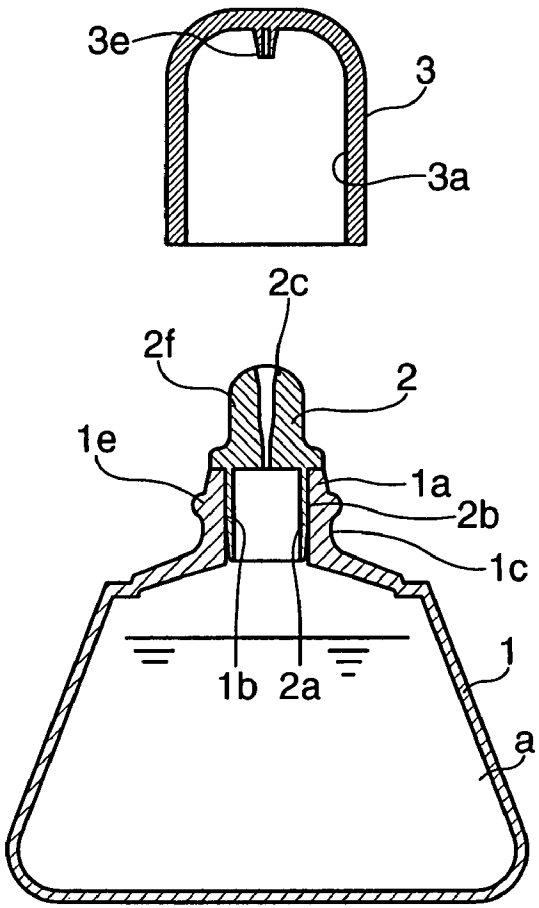
PRIOR ART FIG.14B
FIGS. 14A and 14B are front views in section of another prior art liquid container, showing a state when a cap is mounted and when the cap is detached, respectively.
Figure 14A:
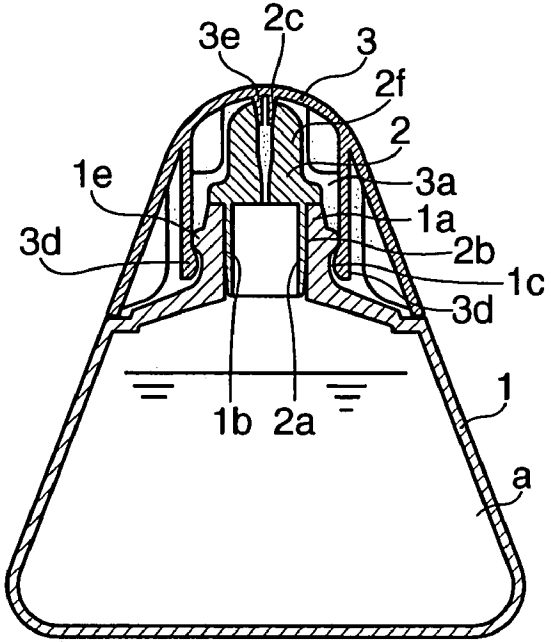
PRIOR ART FIG.14A
Figure 15A:
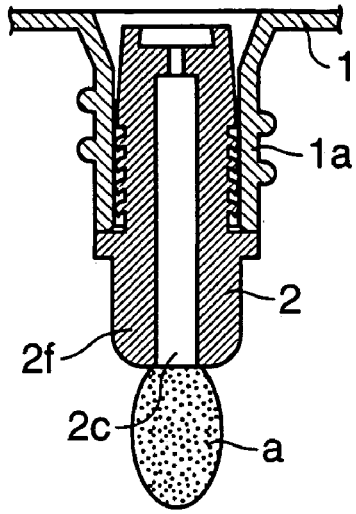
PRIOR ART FIG.15A
FIGS. 15A, 15B, 15C are front views in sections showing discharged states of a content liquid in a state where a conventional nozzle is faced substantially right down, in a state where the conventional nozzle is inclined to face obliquely downward, and in a state where the conventional nozzle is inclined to face obliquely upward from the state of FIG. 15B, respectively.
Figure 15B:
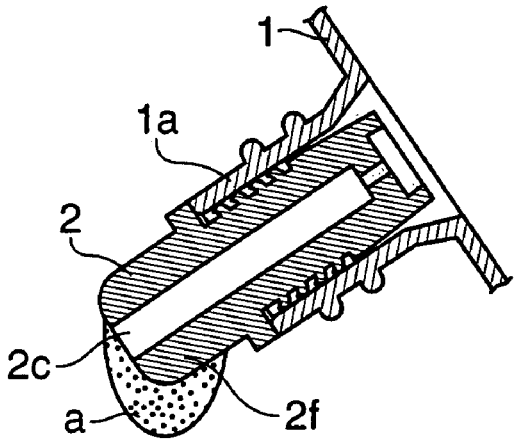
PRIOR ART FIG.15B
Figure 15C:
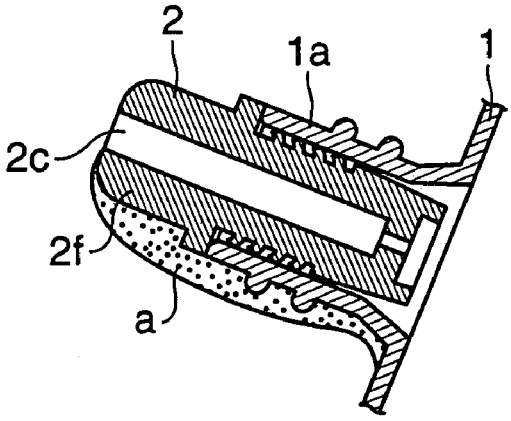
PRIOR ART FIG.15C

In a liquid container 10B' of the twist cap type shown in FIGS. 12A and 12B, an inner circumferential surface 13*a* of a cap 13B' is located more outward and a plurality of (four in this example) fins 13*m* radially projecting inward while being circumferentially spaced at even intervals are formed on the inner circumferential surface 13*a* of the cap 13B' instead of hermetically brining the inner circumferential surface 13*a* into contact with the ring-shaped projection 12*h* of the nozzle 12, and the inner ends of these fins 13*m* are held in contact with the ring-shaped projection 12*h* of the nozzle 12. It should be noted that the inner ends of the fins 12*m* need not always be in contact with the ring-shaped projection 12*h* of the nozzle 12. These fins 13*m* are formed to center the nozzle 12.

Accordingly, the inner circumferential surface 13*a* of the cap 13B' and the ring-shaped projection 12*h* of the nozzle 12 are not hermetically held in contact in this liquid container 10B' of the twist cap type. Thus, no airtight air pool 13*g* is formed.

However, even such a liquid container 10B' of the twist cap type can enjoy the functions and effects brought about by the ring-shaped fins 12*e* of the nozzle 12 and those brought about by the ring-shaped projection 12*h* by the nozzle 12 similar to the liquid container 10B of the twist cap type shown in FIG. 2.

As described above, an inventive nozzle structure for a liquid container in which a nozzle is provided on the top of a tubular neck portion of a container body, a cap is mounted on the tubular neck portion, and a discharging hole of the nozzle is hermetically sealed by an inner top portion of the cap, wherein a ring-shaped projection is formed on an upper portion of the nozzle.

In this nozzle structure, the ring-shaped projection of the nozzle has both a barrier-wall function for preventing a liquid leak and a core function for forming liquid drops.

Specifically, if the ring-shaped projection is formed on the upper portion of the nozzle, a content liquid comes out of the discharging hole and runs toward the upper portion of the nozzle in the case that the nozzle is inclined to face obliquely downward while the content liquid is being caused to drip from the discharging hole of the nozzle with the nozzle faced substantially right down. If the nozzle is further inclined to face obliquely upward in this state, the content liquid is difficult to drip because it runs down to the tubular neck portion of the container body from the upper portion of the nozzle or cannot be formed well into liquid drops. In such a case, the liquid leak can be securely prevented since the ring-shaped projection serves as a barrier wall for damming up the content liquid trying to run down.

The higher the barrier wall, the better the effect. Thus, it is preferable to make the barrier wall formed by the ring-shaped projection higher by forming a constricted portion, for example, below the ring-shaped projection of the nozzle.

Further, since the ring-shaped projection functions as a core for forming the content liquid dammed up here into liquid drops by the surface tension, the content liquid drips better as a result. Further, drops can be easily formed not only when the nozzle is faced substantially right down, but also when the nozzle is horizontally held or inclined to face obliquely downward. In other words, drops can be easily formed independently of a dripping angle. Thus, the content liquid can be caused to drip via the ring-shaped projection of the nozzle.

The expression "the nozzle is provided on the top of the tubular neck portion of the container body" includes a case where the nozzle is integrally formed on the top of the tubular neck portion of the container body in addition to a case where the nozzle is hermetically inserted into the tubular neck portion and a case where the nozzle is formed on the top of the cap hermetically mounted on the tubular neck portion of the container body.

Further, the expression "the discharging hole is hermetically sealed by the inner top portion of the cap" means to hermetically seal the discharging hole by pressing the inner top surface of the cap against the top surface of the discharging hole in the liquid container of the screw cap type and to hermetically seal the discharging hole by inserting a projection on the inner top surface of the cap into the discharging hole while forcibly widening the discharging hole in the liquid container of the twist cap type.

Another inventive nozzle structure for a liquid container in which a nozzle is provided on the top of a tubular neck portion of a container body, a cap is detachably mounted on the tubular neck portion such that an inner circumferential surface of the cap is in contact with an outer circumferential surface of the tubular neck portion, and a discharging hole of the nozzle is hermetically sealed by an inner top portion of the cap, wherein a ring-shaped projection to be hermetically brought into contact with the inner circumferential surface of the cap is formed on an upper portion of the nozzle.

In this nozzle structure, the inner circumferential surface of the cap is hermetically in contact with the ring-shaped projection formed on the upper portion of the nozzle with the cap mounted. Thus, double sealing can be provided in cooperation with the hermetic sealing of the discharging hole of the nozzle by the inner top portion of the cap, with the result that the liquid leak can be more securely prevented.

In short, a hermetically sealed state is attained only by sealing the discharging hole of the nozzle by the inner top surface of the cap to prevent a liquid leak, and a higher precision control such as a higher assembling precision of the nozzle and the cap and a tightening torque are required in the prior art nozzle structure. However, since the hermetically sealed state can be structurally compensated for by forming a sealing portion by the ring-shaped projection, the liquid leak can be securely suppressed and precision conditions such as an assembling precision of the nozzle and the cap and a tightening torque can be alleviated. There is an additional effect that a precision control is easy in a production process for products using liquid containers having these structures.

The ring-shaped projection has both a barrier-wall function for preventing a liquid leak and a core function for forming liquid drops.

Still another inventive nozzle structure for a liquid container in which a nozzle is inserted into a tubular neck portion of a container body such that an outer circumferential surface of a lower portion of the nozzle is hermetically held in contact with an inner circumferential surface of the tubular neck portion, a cap is detachably mounted on the tubular neck portion such that an inner circumferential surface of the cap is spirally engaged with or locked into an outer circumferential surface of the tubular neck portion, and a discharging hole of the nozzle is hermetically sealed by an inner top portion of the cap, wherein a ring-shaped projection to be hermetically brought into contact with the inner circumferential surface of the cap is formed on an upper portion of the nozzle.

In this nozzle structure, the inner circumferential surface of the cap is hermetically brought into contact with the ring-shaped projection formed on the upper portion of the nozzle when the cap is mounted by being spirally engaged with or locked into the tubular neck portion. Thus, double sealing can be provided in cooperation with the hermetic sealing of the discharging hole of the nozzle by the inner top portion of the cap, with the result that the liquid leak can be more securely prevented.

The ring-shaped projection has both a barrier-wall function for preventing a liquid leak and a core function for forming liquid drops.

Further another inventive nozzle structure for a liquid container in which a nozzle is formed on the top of a cap hermetically mounted on a tubular neck portion of a container body, an upper lid is coupled to the cap via a hinge, and a discharging hole of the nozzle is hermetically sealed by an inner top portion of the upper lid, wherein a ring-shaped projection to be hermetically brought into contact with the inner circumferential surface of the cap is formed on an upper portion of the nozzle.

In this nozzle structure, the inner circumferential surface of the upper lid is hermetically brought into contact with the ring-shaped projection formed on the upper portion of the nozzle when the upper lid is mounted on the nozzle of the cap. Thus, double sealing can be provided in cooperation with the hermetic sealing of the discharging hole of the nozzle by the inner top portion of the upper lid, with the result that the liquid leak can be more securely prevented.

The ring-shaped projection has both a barrier-wall function for preventing a liquid leak and a core function for forming liquid drops.

The expression "the cap is hermetically mounted on the tubular neck portion of the container body" includes a case where the cap is undetachably fixed by a known melting method after being hermetically engaged with the tubular neck portion in addition to a case where the cap is spirally engaged with the tubular neck portion.

Preferably, an airtight air pool is formed between a hermetically sealed portion of the inner top portion of the cap and the discharging hole of the nozzle and a hermetic contact portion of the inner circumferential surface of the cap and the ring-shaped projection of the nozzle. Then, the liquid leak from the discharging hole of the nozzle can be more securely prevented by the action of an air pressure in this air pool.

Further, a constricted portion is preferably formed below the ring-shaped projection of the nozzle. Then, the content liquid collected at the ring-shaped projection by the surface tension is made unlikely to run down by the constricted portion. Therefore, the liquid dripping from the nozzle can be more securely prevented, with the result that the liquid drops can be more easily formed.

Preferably, at least two ring-shaped fins whose edges are to be hermetically brought into contact with the inner circumferential surface of the tubular neck portion upon inserting the nozzle into the tubular neck portion are formed on the outer circumferential surface of the lower portion of the nozzle while being vertical spaced apart, and an airtight air pool is formed between hermetic contact portions of the respective ring-shaped fins and the inner circumferential surface of the tubular neck portion. Then, the liquid leak through a clearance between the tubular neck portion of the container body and the nozzle can be more securely prevented by the action of an air pressure in this air pool.

This application is based on patent application Nos. 2002-308504 and 2003-67739 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A nozzle which is to be provided on a top of a tubular neck portion of a liquid container, the tubular neck portion being configured to be mounted with a cap, the nozzle having opposite top and bottom ends and comprising:

a discharging hole extending through the nozzle from the top end towards the bottom end and being disposed to be hermetically sealed by an inner top portion of the cap;

a flange portion spaced from the top end of the nozzle and configured to be in contact with the top of the tubular neck portion of the liquid container;

a ring-shaped projection formed between the flange portion and the top end of the nozzle and spaced from the flange portion and the top end of the nozzle;

a constricted portion extending between the ring-shaped projection and the flange portion of the nozzle, the constricted portion having an inwardly curved external surface with a minimum cross-sectional dimension that is less than external cross-sectional dimensions defined by the flange portion and the ring-shaped projection; and a convex arcuate portion extending from the top end of the nozzle to the ring-shaped projection, the convex arcuate outer surface defining a maximum external cross-sectional dimension that is less than the external cross-sectional dimension of the ring-shaped projection but greater than the minimum cross-sectional dimension of the constricted portion.

2. A nozzle which is to be provided on a top of a tubular neck portion of a liquid container, the tubular neck portion being detachably mounted with a cap such that an inner circumferential surface of the cap is in contact with an outer circumferential surface of the tubular neck portion, the nozzle having opposite top and bottom ends and comprising:

a discharging hole extending through the nozzle from the top end towards the bottom end and being disposed to be hermetically sealed by an inner top portion of the cap;

a flange portion spaced from the top end of the nozzle and in contact with the top of the tubular neck portion of the liquid container;

a ring-shaped projection to be hermetically brought into contact with the inner circumferential surface of the cap, the ring-shaped projection being formed between the flange and the top end of the nozzle and spaced from the flange and the top end of the nozzle;

a constricted portion between the ring-shaped projection and the flange portion of the nozzle, the constricted portion having an inwardly curved external surface with a minimum cross-sectional dimension that is less than external cross-sectional dimensions defined by the flange portion and the ring-shaped projection; and a convex arcuate portion extending from the top end of the nozzle to the ring-shaped projection, the convex arcuate outer surface defining a maximum external cross-sectional dimension that is less than the external cross-sectional dimension of the ring-shaped projection but greater than the minimum cross-sectional dimension of the constricted portion.

3. A nozzle according to claim 1, wherein at least two ring-shaped fins whose edges are to be hermetically brought into contact with an inner circumferential surface of the tubular neck portion upon inserting the nozzle into the tubular neck portion are formed on an outer circumferential surface of the nozzle between the flange portion and the bottom end portion of the nozzle while being vertical spaced apart, and an airtight air pool is formed between hermetic contact portions of the respective ring-shaped fins and the inner circumferential surface of the tubular neck portion.

4. A nozzle having opposite top and bottom ends, portions of the nozzle between the ends being configured to be inserted into a tubular neck portion of a liquid container such that an outer circumferential surface of a lower portion of the nozzle is hermetically held in contact with an inner circumferential surface of the tubular neck portion, the tubular neck portion being detachably mounted with a cap such that an inner circumferential surface of the cap is spirally engaged with or locked into an outer circumferential surface of the tubular neck portion, the nozzle comprising:

a discharging hole extending from the top end of the nozzle and into the liquid container, the discharging hole being disposed to be hermetically sealed by an inner top portion of the cap;

a flange portion spaced from the top and bottom ends of the nozzle and in contact with the top of the tubular neck portion of the liquid container;

a ring-shaped projection to be hermetically brought into contact with the inner circumferential surface of the cap, the ring-shaped projection being formed between the flange portion and the top end of the nozzle and spaced from the flange portion and the top end of the nozzle;

a constricted portion between the ring-shaped projection and the flange portion of the nozzle, the constricted portion having an inwardly curved external surface with a minimum cross-sectional dimension that is less than external cross-sectional dimensions defined by the flange portion and the ring-shaped projection; and a convex arcuate portion extending from the top end of the nozzle to the ring-shaped projection, the convex arcuate outer surface defining a maximum external cross-sectional dimension that is less than the external cross-sectional dimension of the ring-shaped projection but greater than the minimum cross-sectional dimension of the constricted portion.

5. A nozzle according to claim 4, wherein at least two ring-shaped fins whose edges are to be hermetically brought into contact with the inner circumferential surface of the tubular neck portion upon inserting the nozzle into the tubular neck portion are formed on the outer circumferential surface of the nozzle while being spaced apart from one another between the flange portion and the bottom end of the nozzle, and an airtight air pool is formed between hermetic contact portions of the respective ring-shaped fins and the inner circumferential surface of the tubular neck portion.

6. A nozzle which is formed on a top of a cap hermetically mounted on a tubular neck portion of a liquid container, the cap being coupled with an upper lid via a hinge, the upper lid being formed with a tubular portion on an inner top portion thereof, the nozzle comprising:

opposite top and bottom ends, the bottom end at the top of the cap;

a discharging hole extending through the nozzle from the top end substantially to the bottom end and being disposed to be hermetically sealed by the inner top portion of the upper lid;

a ring-shaped projection to be hermetically brought into contact with an inner circumferential surface of the tubular portion of the upper lid, the ring-shaped projection being formed between the top of the cap and the top end of the nozzle and spaced from the top of the cap and the top end of the nozzle;

a constricted portion between the ring-shaped projection of the nozzle and the bottom end of the nozzle, the constricted portion having an inwardly curved external surface with a minimum cross-sectional dimension that is less than an external cross-sectional dimension defined by the ring-shaped projection; and a convex arcuate portion extending from the top end of the nozzle to the ring-shaped projection, the convex arcuate outer surface defining a maximum external cross-sectional dimension that is less than the external cross-sectional dimension of the ring-shaped projection but greater than the minimum cross-sectional dimension of the constricted portion.

7. A nozzle which is to be provided on a top of a tubular neck portion of a liquid container, the, nozzle having opposite and bottom ends comprising:

a discharging hole extending from the top end towards the bottom end for discharging liquid from the liquid container;

a flange portion spaced from the top end of the nozzle and configured to be in contact with the top of the tubular neck portion of the liquid container;

a ring-shaped projection formed between and spaced from the flange portion and the top end of the nozzle;

a constricted portion between the ring-shaped projection and the flange portion of the nozzle, the constricted portion having an inwardly curved external surface with a minimum cross-sectional dimension that is less than external cross-sectional dimensions defined by the flange portion and the ring-shaped projection; and a convex arcuate portion extending from the top end of the nozzle to the ring-shaped projection, the convex arcuate outer surface defining a maximum external cross-sectional dimension that is less than the external cross-sectional dimension of the ring-shaped projection but greater than the minimum cross-sectional dimension of the constricted portion.

8. A nozzle according to claim 1, wherein the ring-shaped projection has a tapered or chamfered upper surface that intersects the convex arcuate portion extending from the top end of the nozzle.

9. A nozzle according to claim 2, wherein the ring-shaped projection has a tapered or chamfered upper surface that intersects the convex arcuate portion extending from the top end of the nozzle.

10. A nozzle according to claim 4, wherein the ring-shaped projection has a tapered or chamfered upper surface that intersects the convex arcuate portion extending from the top end of the nozzle.

11. A nozzle according to claim 6, wherein the ring-shaped projection has a tapered or chamfered upper surface that intersects the convex arcuate portion extending from the top end of the nozzle.

12. A nozzle according to claim 7, wherein the ring-shaped projection has a tapered or chamfered upper surface that intersects the convex arcuate portion extending from the top end of the nozzle.

13. A nozzle according to claim 1, wherein the nozzle is formed unitarily from a synthetic resin.

14. A nozzle according to claim 2, wherein the nozzle is formed unitarily from a synthetic resin.

15. A nozzle according to claim 4, wherein the nozzle is formed unitarily from a synthetic resin.

16. A nozzle according to claim 6, wherein the nozzle is formed unitarily from a synthetic resin.

17. A nozzle according to claim 7, wherein the nozzle is formed unitarily from a synthetic resin.

* * * * *